US006463252B2

(12) United States Patent
Omoto et al.

(10) Patent No.: US 6,463,252 B2
(45) Date of Patent: Oct. 8, 2002

(54) FIXING DEVICE EMPLOYING AN INDUCTION HEATING METHOD

(75) Inventors: Tetsuko Omoto; Miho Toyoda, both of Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/894,401

(22) Filed: Jun. 28, 2001

(65) Prior Publication Data

US 2002/0006296 A1 Jan. 17, 2002

(30) Foreign Application Priority Data

Jul. 4, 2000 (JP) ..... 2000-202043
Jul. 18, 2000 (JP) ..... 2000-217499

(51) Int. Cl.[7] ..... G03G 15/20; H05B 6/14

(52) U.S. Cl. ..... 399/330; 219/216; 219/619; 399/328; 399/334; 399/333

(58) Field of Search ..... 219/216, 619; 399/328, 330, 333, 334

(56) References Cited

U.S. PATENT DOCUMENTS 5,666,627 A * 9/1997 Yamaguchi ..... 399/330
5,822,669 A * 10/1998 Okabayashi et al. ..... 399/330

FOREIGN PATENT DOCUMENTS

| | | |
|---|---|---|
| JP | 54-039645 | 3/1979 |
| JP | 09-106207 | 4/1997 |
| JP | 11-190950 | 7/1999 |

* cited by examiner

*Primary Examiner*—Hoang Ngo
(74) *Attorney, Agent, or Firm*—Frishauf, Holtz, Goodman & Chick, P.C.

(57) ABSTRACT

A fixing device for fixing a toner image on a sheet, wherein the toner image is formed by a thermally meltable toner. The fixing device includes an induction heater to heat the toner image. The induction heater includes a hollow rotatable conductive member, a heating member provided inside the hollow rotatable conductive member, and a sendust layer provided inside the hollow rotatable conductive member. The fixing device also includes a pressing member to press the toner image.

11 Claims, 11 Drawing Sheets

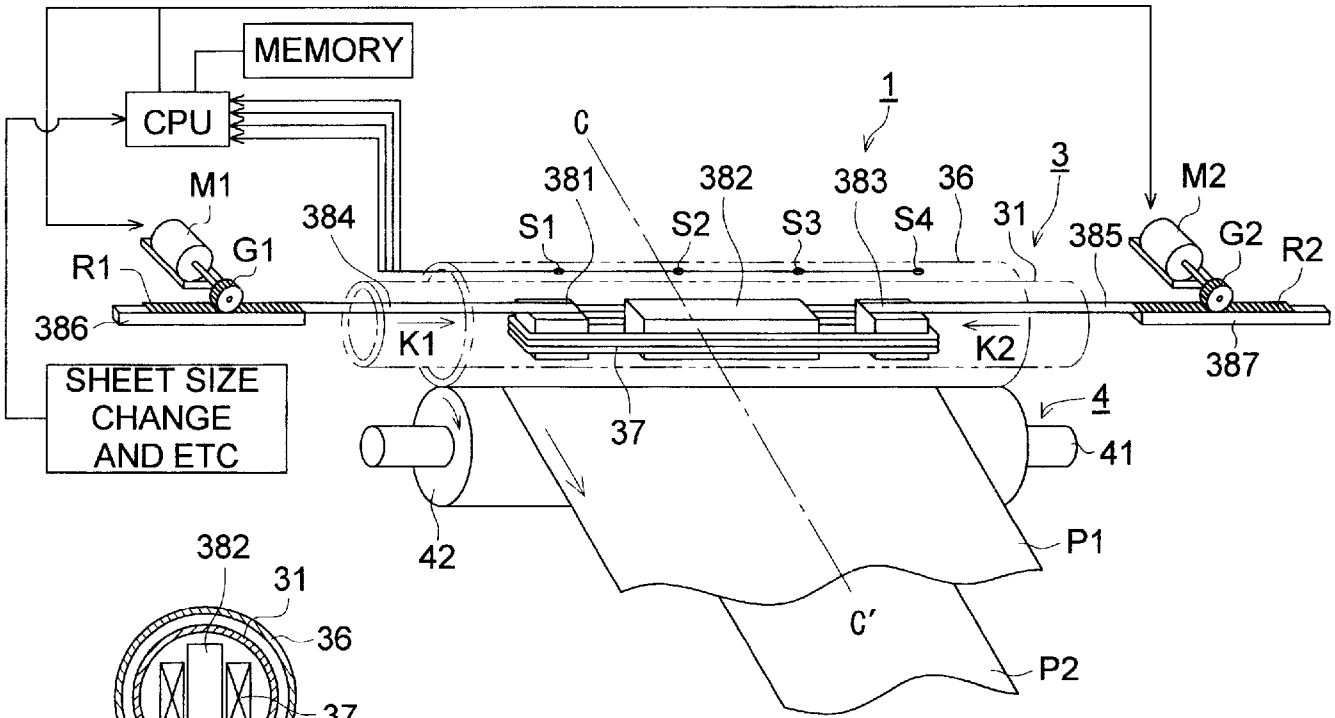
FIG. 10 ( a )
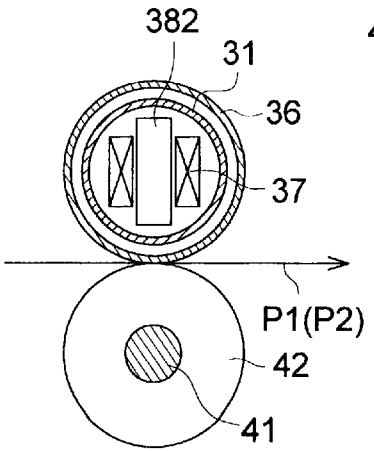
FIG. 10 ( b )

FIXING DEVICE EMPLOYING AN INDUCTION HEATING METHOD

BACKGROUND OF THE INVENTION

The present invention relates to a fixing apparatus employing an induction heating method (an electromagnetic inducing heating method) to press, heat and fix toner images, which are obtained by developing electrostatic latent images with thermally meltable toner.

Conventionally, for image forming apparatuses, which are used for high speed, high image quality copiers and printers, frequently employed is a method of developing electrostatic latent images, typified by an electrophotographic method.

In this method, electrostatic images are developed with thermally meltable toner, and after the obtained toner images are transferred onto a recording medium, the toner images are fixed with heat and pressure. As a heat source used in a fixing apparatus, a halogen lamp has been commonly used.

However, in recent years, an apparatus applying an electromagnetic induction system, which is characterized by direct heating of a heat receiving member (a heat roller, etc.) and high heating efficiency, has been extensively studied. (For example, as described in Tokkaihei 11-190950.) However, it has become more and more apparent that an electromagnetic induction fixing apparatus has some problems and without countermeasures, the apparatus is not likely to come into practical use.

Conventionally, as heat-receiving members, an electro conductive roller, a magnetic metal roller, or a roller comprised of multi layers of Ni and Cu, etc. on insulating body have been used. However, there are many cases where ferromagnetic materials have low electric conductivity, or materials of high electric conductivity have low relative magnetic permeability, and large eddy current cannot be obtained, and heating efficiency is not so high as expected.

Further, in cases of using a halogen lamp, temperature of the heat-receiving member is measured and power supply is cut off in accordance with the measured value in order to control the temperature. In this case, if the power supply is cut off after the temperature reaches a predetermined value, a large overshoot is often caused by a delay of the action. Also, in electromagnetic induction fixing, wherein material with exceedingly higher Curie temperature, than usual fixing temperature, is used for the heat receiving member and core, a large overshoot as aforementioned cases arises in cases where, a heat receiving material with low thermal capacity is used and high electrical power is supplied, aiming for a rapid temperature rise.

Alternatively, in cases where correct temperature cannot be detected because of failure in a temperature sensor, a thermal runaway occurs and neighboring parts would be damaged, and in the worst case, would be burned. For these cases, decreasing the overshoot as far as possible, and in the case of overheating, restricting a heat generating rate to low levels are important subjects.

Further, depending on the size of the recording medium (or recording paper), required heat distribution is different, and this causes an abnormal increase of temperature at areas distant from the center of the heat-receiving member, therefore, equalization of this temperature distribution is another subject.

Furthermore, in an apparatus wherein a conventional way of winding an induction coil is applied, uneven temperature distribution is caused in the circumferential direction of the heat-receiving member, therefore in order to equalize the temperature, increasing the previous revolutions of the heat-receiving member (fixing roller, etc.) is required. Still more, when a thick heating roller with large heat capacity is used, a long warming up time is needed, and when a thin heating roller or a roller with low heat conductivity is used, unevenness of temperature tends to be caused.

The present invention is performed to overcome the above-described shortcomings.

Namely, the first object of the present invention is to provide an inducing heating type fixing apparatus with short warming up time (WUT) by using high magnetic permeability and high electrical conductivity alloy which generates eddy current effectively.

The second object of the present invention is to provide an inducing heating type fixing apparatus, wherein temperature overshoot is minimized, and in case of overheating the heat generation rate is suppressed.

The third object of the present invention is to provide an inducing heating type fixing apparatus in which temperature unevenness in the circumferential direction of a heat-receiving member (fixing roll, etc.) is decreased.

Incidentally, the fixing apparatus utilizing electromagnetic induction usually comprises a heating means and a pressure means, and both means contact each other to grip and transport the toner image bearing recording medium and fix the image. Said heating means comprises roll or belt-shaped rotatable heat receiving member in which provided a helical coil or a vertically wound coil, and a core if necessary. Alternating current, whose frequency is preferably 5 kHz or higher, is supplied to said coil to generate an alternating magnetic field, and eddy current is induced in said heat receiving member, then, the eddy current loss causes a heat generation in the heat receiving member. With this heat, cooperating with pressure, which is applied elastically by said pressure means, toner images are fixed onto the recording medium.

The above fixing apparatus utilizing the electromagnetic induction has superior characteristics to a fixing apparatus, which uses an infrared heater or a nichrome wire heater, in that; the apparatus can be made in small size and light weight, and almost free from a fear of fire, the power consumption loss is small, a warm up time is very short after starting a supply of high frequency alternating current, etc. Therefore, studies and developments of the fixing apparatus utilizing the electromagnetic induction have been performed recently. For example, in Tokkaisyo 54-39645(official report 1), and Tokkaihei 9-106207(official report 2), etc., various technologies concerning the fixing apparatus utilizing the electromagnetic induction are proposed.

Said official report 1 relates to a heating means for a fixing apparatus wherein high frequency AC current is supplied to a helically wound coil, and eddy current is induced in a heat-receiving member, which is made of electro conductive ferromagnetic material and rotatably provided around the coil, and generated heat is used for fixing. And the official report 1 describes that, said coil in the heating means is wound coarsely at the area near the center in the longitudinal direction of the heating means, and wound thickly at the area near the side ends, and the heat-receiving member is evenly heated in the longitudinal direction.

Further, the official report 2 relates to a fixing apparatus wherein high frequency AC power is supplied to a plurality of coils wound vertically around divided cores, and eddy current is induced in a heat-receiving member, which is made of electro conductive ferromagnetic material and rotatably provided around the coil, and the generated heat is used for fixing. And the report 2 describes that said coils provided near the center in the longitudinal direction of the heat receiving member are connected in parallel, and coils provided near the ends are connected in series to said coils connected in parallel, and by this configuration, the temperature distribution of the heat-receiving member in the longitudinal direction is equalized.

However, conventional fixing apparatuses utilizing an electromagnetic induction described in the official report 1 and 2, etc. are aiming for an equalization of the temperature distribution in a certain fixed operation mode, and can not deal with the cases of various modes in the process of forming fixed images where various power consumption distributions are required, such as a warming up mode, a large sized paper transporting mode, a small sized paper transporting mode, and a standby mode, etc. Especially, there have been problems such that, in a large sized paper transporting mode, temperature at side parts of paper in the perpendicular direction to the paper transport direction becomes too low and causes fixing failure, or in a small sized paper transporting mode, temperature of the heat receiving member in no-paper transport area becomes too high and unnecessary electrical power is consumed.

The present invention is proposed on the above background, and the fourth object of the present invention is to provide a fixing apparatus that does not cause a fixing failure nor unnecessary power consumption, and always produces a properly fixed images and achieves a power saving, even when various modes required in the process of forming fixed images are changed, especially when transported paper size is changed.

SUMMARY OF THE INVENTION

Inventers of the present invention found that the objects of the present invention described above can be achieved by employing the constructions hereinafter described.

(1) An inducing heating type fixing apparatus, which fixes, with pressure and heat, a toner image obtained by developing an electrostatic latent image with thermally meltable toner, wherein an electro conductive hollow rotating member is used, and inside of which is provided a sendust layer.

(2) An inducing heating type fixing apparatus, which fixes, with pressure and heat, a toner image obtained by developing an electrostatic latent image with thermally meltable toner, wherein an electro conductive hollow or solid rotating member is used, and on the outer surface of which is provided a sendust layer.

(3) An inducing heating type fixing apparatus, which fixes, with pressure and heat, a toner image obtained by developing an electrostatic latent image with thermally meltable toner, wherein a hollow or solid column rotating member is used and the material of which is sendust.

(4) An inducing heating type fixing apparatus, which fixes, with pressure and heat, a toner image obtained by developing an electrostatic latent image with thermally meltable toner, wherein a heat-receiving member has a heat generating layer which is comprised of at least electro conductive magnetic material, and the Curie temperature of the material of this heat generating layer is higher than the predetermined fixing temperature, and is lower than the heat resistance temperature of the fixing apparatus.

(5) An inducing heating type fixing apparatus, which fixes, with pressure and heat, a toner image obtained by developing an electrostatic latent image with thermally meltable toner, wherein magnetic material, used as the coil core, is divided into separate plural parts in the direction perpendicular to the recording paper transport direction, and said ferrite core parts are composed of materials of different Curie temperature.

(6) A fixing apparatus as described in paragraph (5), wherein the Curie temperature of said separated magnetic core, which is provided at an area where heating is required when small size paper is transported, is different from that of the core in other areas where heating is not required during that period, and a core of higher Curie temperature is used at the heat requiring area than that of other cores.

(7) The fixing apparatus as described in paragraph (5), wherein the Curie temperature of said core is higher than the predetermined fixing temperature and lower than the heat resistance temperature of the fixing apparatus.

(8) An inducing heating type fixing apparatus, which fixes, with pressure and heat, a toner image obtained by developing an electrostatic latent image with thermally meltable toner, wherein an induction coil (exciting coil), which is provided in a heat-receiving member, is wound around a high magnetic permeability magnetic core so as to form a radial configuration in cross section.

(9) An inducing heating type fixing apparatus, which fixes, with pressure and heat, a toner image obtained by developing an electrostatic latent image with thermally meltable toner, wherein at least two vertically wound induction coils, which are provided in a heat receiving member and are wound parallel in the longitudinal direction, and are aligned at different radial directions of said heat receiving member.

The first object of the present invention is achieved by the constructions (1), (2) and (3), the second object is achieved by (4), (5), (6) and (7), and the third object is achieved by (8) and (9).

The fourth object can be achieved by the following constructions.

(10) A fixing apparatus comprising a hollow cylindrical heat-receiving member made of electro conductive material, and a heating means including an alternating current power source and a coil, wherein said coil is separated to a coil which heats the area near the center of the heat receiving member in the longitudinal direction, and coils which heat both side areas of the heat receiving member, and at least one of these coils is provided outside the heat-receiving member.

(11) A fixing apparatus as described in (10), wherein said coils, which heat both side areas, are connected in series.

(12) A fixing apparatus as described in (10) or (11), wherein said coil, which heats an area near the center of the heat receiving member in the longitudinal direction, and said coils, which heat both side areas, are supplied power from separate power sources and controlled independently.

(13) In a fixing apparatus comprising; a hollow cylindrical heat-receiving member made of electro conductive material; and a heating means including an alternating current power source, a core and a vertically wound coil; wherein said core is movably provided.

(14) A fixing apparatus as described in (13), wherein said core is divided into plural cores in the longitudinal direction, and at least one of said cores is installed movably in the longitudinal direction.

BRIEF DESCRIPTION OF THE DRAWINGS

FIGS. 10(*a*) and 10(*b*) each is a drawing illustrating a configuration of the fixing apparatus of (13) and (14).

DETAILED DESCRIPTION OF THE PREFERRED EMBODIMENT

The first embodiment of the present invention can be conducted by any of constructions (1), (2), and (3), herein the sendust material being employed in the present invention, is a high magnetic permeability alloy which is composed of 5% Al, 10% Si, and 85% Fe. The term "sendust" is described in detail in IWANAMI RIKAGAKU JITEN (Iwanami Physics and Chemistry Dictionary published by Iwanami Shoten). Due to its high magnetic permeability and high electro conductivity, the sendust generates a large eddy current loss and causes extremely large heat generation (proportional to the second power). Other than this, as an inducing heating type fixing apparatus, a heat receiving member, a core, an induction coil, etc. are necessary, and commonly used members are usable for this apparatus.

Figure 1:
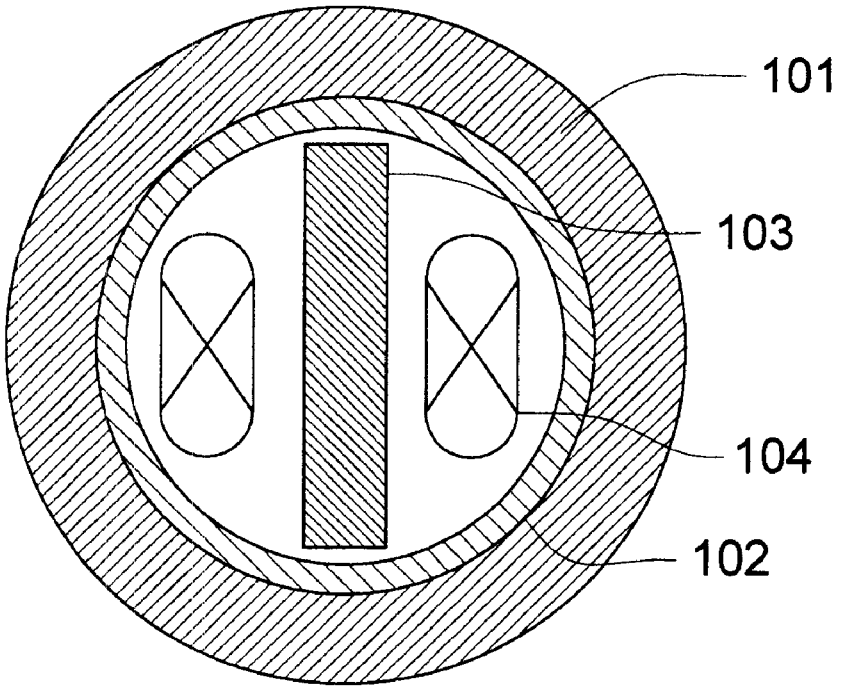
FIG. 1 is a section view of a heat roller.

A sectional view of FIG. 1 shows an example of typical embodiments of the present invention, wherein a heat roller 101 (which is described also as a "heat-receiving member" in the present invention) is made of aluminum cylinder, and on the inner surface of the cylinder is provided a sendust layer 102. Inside the heat roller are provided a magnetic core 103 and an induction coil 104 comprising a litz line wound parallel to the longitudinal direction. Since the sendust layer has high magnetic permeability and high electro conductivity, a large eddy current is generated in the layer. Joule heat caused by the eddy current loss generated in the sendust layer is supplied for heat fixing through the high thermal conductive aluminum cylinder.

As embodiments of the present invention, other than the example described above, there is a construction wherein a sendust layer is provided on the outer surface of the heat roller (or heat receiving member), or the heat roller itself is made of sendust material and a coil is provided outside or inside of the roll. Any of these constructions can be used.

The second embodiment of the present invention can be conducted by any of the constructions of (2) through (7). In an inducing heating type fixing apparatus, wherein electric current is supplied to a coil and a heat-receiving member is heated, said heat-receiving member and core are preferably made of magnetic material with high magnetic permeability, from a view point of energy saving, because of a high heat generation rate which results a reduction of consumed electric power during WUT (warming up time) On the other hand, a high heat generation rate often causes a high overshoot of the temperature, and when abnormality occurs in the temperature control, the apparatus will be abnormally overheated in a short period.

Magnetic materials are characteristic of becoming non-magnetic when they reach the Curie temperature. The present invention utilizes this characteristic.

1. In cases where a heat-receiving member is comprised of a magnetic material having the Curie temperature higher than the predetermined fixing temperature and lower than the heat resistance temperature of the fixing apparatus, even when the heat-receiving member reaches an abnormally high temperature, at higher temperature than the Curie temperature the heat-receiving member becomes nonmagnetic, then the heat generating rate decreases to suppress abnormal temperature rise.

2. Also, by using a core, comprised of a magnetic material, having the Curie temperature higher than the fixing temperature but lower than the heat resistance temperature of the fixing apparatus, the same effect can be achieved.

3. By dividing the core into several parts in the longitudinal direction of the heat-receiving member and using materials of different Curie temperatures, the longitudinal temperature distribution can be equalized. When small sized papers are transported through the fixing apparatus, the heat-receiving member beyond the paper width receives more heat than required, and the temperature there is raised abnormally. Nevertheless, by using a core made of a material having a lower Curie temperature than that of the central part, this abnormal temperature rise can be suppressed.

Figure 2:
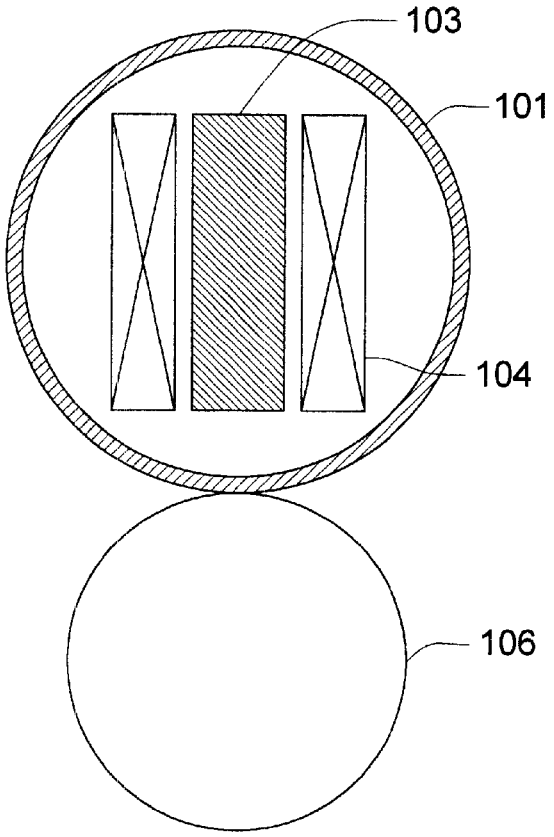
FIGS. 2(*a*) and 2(*b*) each is a section view of another heat roller.
Figure 2:
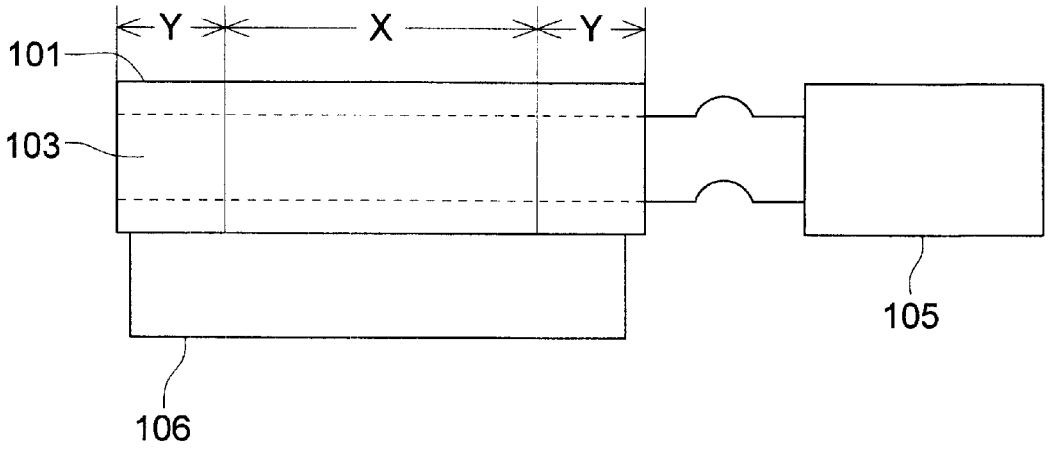

FIG. 2 shows a typical example of the second embodiment of the present invention. FIG. 2 (1) is a section view of a heat roller taken in circumferential direction, and FIG. 2 (2) is a section view of the heat roller, also taken in longitudinal direction. In a heat roller 101(heat-receiving member), a core 103 and an induction coil 104 are provided. Further, 105 is a power source which supplies alternating electric power, and 106 is a pressure roller which is pressed onto the heat roller 101 (cylindrical rotating body) and forms a nip between them.

In the present invention, a core for the coil and a heat-receiving member are preferably comprised of high magnetic permeability materials, and said core preferably has high electrical resistivity.

The Curie temperature of the core or the heat-receiving member is designated ta (° C.), and when the temperature necessary to fix a toner image is designated "T":

$$T \leqq ta \leqq T+20(^\circ\ \mathrm{C.})$$

In cases where the core is divided in the longitudinal direction, the Curie temperature of portion "Y" of the core where heat generation is not required during small sized paper transportation (non paper transportation area) is designated tb, and the Curie temperature of portion "X" where heat generation is required during small sized paper transportation (small paper transportation area) is designated tc, the following relations are desirable.

$$T \leqq tb \leqq tc, \text{ and } tc \leqq T+20$$

Heretofore, a cylinder (or a hollow roll) is illustrated as a heat-receiving member of the present invention, however a thin flexible rotating member and an endless belt can be used, further, a composition of more than two different metals or a composition of a magnetic metal layer on a resin base may also be used. These are applicable to all the embodiments of the present invention.

Further, the third embodiment of the present invention can be conducted by a construction of (8) or (9). In this example, coils which are wound parallel to the longitudinal direction are provided so that many maximal temperature areas are generated at least in the circumferential direction of the heat roller.

To realize this, a plurality of induction coils are provided in different radial directions in the heat roller, and high frequency AC power is supplied to the coils to generate a magnetic field, and a heat-receiving member (the heat roller) is heated by Joule heat generated with eddy current.

By increasing the number of maximal temperature areas, unevenness of temperature in the circumferential direction is decreased even when a thin cylinder is used as the heat-receiving member. This allows reducing the preliminary rotation of the roller.

Figure 3:
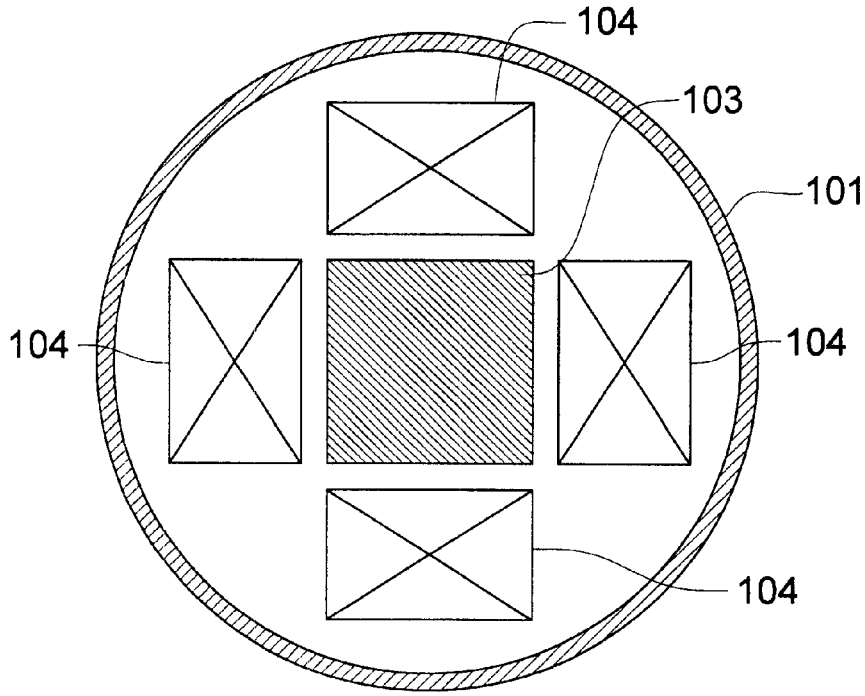
FIGS. 3(*a*) and 3(*b*) each is a section view of still another heat roller.
Figure 3:
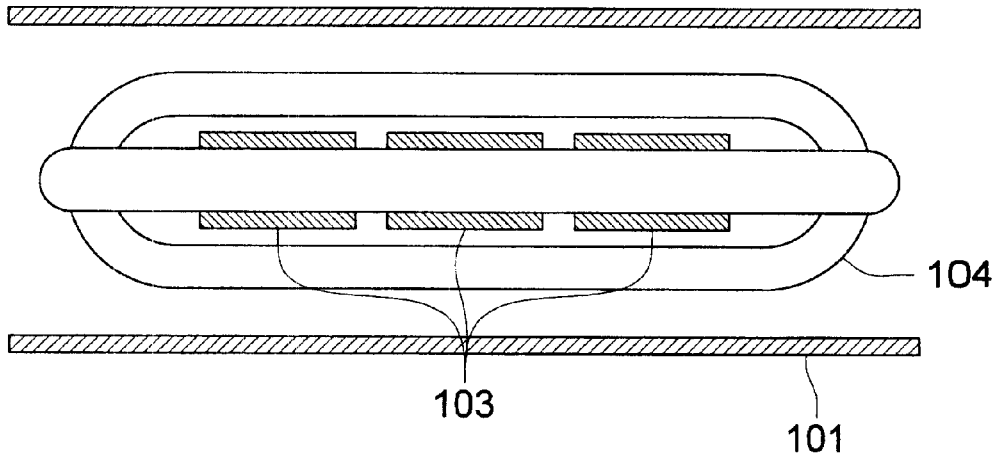

FIG. 3 shows an example wherein two induction coils, which are wound parallel to the longitudinal direction, are provided at different radial directions in the heat roller 101. In said induction coils 104, the ferrite core 103, which is divided into a centerpiece and two sidepieces, is provided. FIG. 3 (1) is a section view of the heat roller taken from the circumferential direction, and FIG. 3 (2) is a section view of the heat roller taken from the longitudinal direction.

High frequency AC power is supplied to the coils 104 to generate a magnetic field, and eddy current is generated in the heat-receiving member (a heat roller), and an eddy current loss generates Joule heat, by which the temperature of the heat-receiving member is raised.

In this example, four maximal temperature areas are generated in the circumferential direction of the roll, while, by additionally providing said coil, the uneven temperature distribution in the circumferential direction can be reduced.

Hereinafter, a thermally meltable toner and an image forming apparatus etc., relating to the present invention will be further described.

1. Thermally Meltable Toner Used in the Present Invention:

As for a toner binding resin, in this invention, thermoplastic resins such as a styrene-acrylic type resin or a polyester type resin, etc. can be used and are not particularly restricted.

As for a coloring agent, commonly known inorganic or organic coloring agents can be used. These coloring agents can be used as a selected single agent or as a combination of plural agents, as desired. The content of the coloring agent is 1 to 20 parts by weight, preferably 2 to 15 parts by weight, for 100 parts by weight of the entire of the toner.

If necessary, a releasing agent, selected from the commonly known agents can be used. For example, polyolefin type compound of a low molecular weight polypropylene, whose weight average molecular weight is 1,000 to 5,000, is desirable.

Further, these releasing agents can be used as a selected single agent or as a combination of plural agents if necessary. The amount of the releasing agent added to toner is preferably 0.1 to 20 parts by weight, for 100 parts by weight of the entire of the toner.

Furthermore, as desired, as a charge control agent, commonly known various agents can be used. Specifically, as the usable charge control agents, there are: a nigrosine type dye, a metal salt of naphthenic acid or higher aliphatic acids, an alkoxylic amine, a quaternary ammonium salt compound, an azoic metal complex, a metal salicylate or it's metal complex, etc.

As a method of making toner, commonly known methods of making toner may be utilized. Specifically, for example, a coloring agent and a charge control agent are added to a resin, and after fully mixed and kneaded, the mixture is cooled and subject to pulverization and classification, to provide colored resin particles.

As for the toner of the present invention, in order to improve its fluidity, charging and a cleaning characteristics, so called additives can be provided on the surface of the above colored resin particles. These additives are not specifically restricted, and various inorganic or organic fine particles and lubricants can be used.

Toner particle size being used in the present invention is preferably 3 to 11 $\mu$m, in volume average particle size. This volume average particle size of toner can be measured for example by using a Coulter-Multisizer. In the measurement using the Coulter-Multisizer, after a particle size distribution in a rage of 2.0 to 40 $\mu$m is determined, using a 100 $\mu$m aperture, a volume average particle size is calculated.

The amount of these additives being added to the toner is preferably 0.1 to 5 weight % of the entire toner quantities. As for an adding method of these additives on the surface of the toner particle, commonly known various mixing apparatus can be employed such as a Turbuler-mixer, a Henshel-mixer, a Noutor-mixer, and a V-shaped mixer, etc.

2. Developer:

Toners related to the present invention can be used as single component developer and as well two components developer.

In cases where toner is used as single component developer, a non-magnetic single component developer or a magnetic single component developer, in which magnetic particles having a diameter about 0.1 to 0.5 $\mu$m are incorporated, can be used as well. The size of these particles is measured by using an electron microscope.

Further, these toners can be used as a two components toner, by mixing it with magnetic carrier particles. As for said magnetic carrier particles, commonly known materials can be used, such as iron metals, ferrite, and magnetite, etc., or alloys of these metals with aluminum or lead. Among these materials, ferrite is especially preferable. A volume average particle size of the magnetic carrier particles is 15 to 100 $\mu$m and preferably 25 to 80 $\mu$m.

Measurement of the volume average particle size can be typically conducted using a laser diffraction type particle size distribution measurement apparatus, HELOS, which is equipped with a wet dispersion device and made by SYMPATEC Corp.

As a carrier, a type of magnetic particles coated with resin, or a type of resin dispersion, which is made by dispersing magnetic particles in a resin, is preferable. The composition of a resin used for coating a carrier is not especially restricted, and such as the following resins can be used, an olefin type resin, a styrene type resin, a styrene acrylic type resin, a silicone type resin, an ester type resin, or fluorinated polymer type resin, etc. Further, as a resin composing a resin dispersion type carrier, is not particularly restricted and commonly known resins can be used, such as, a styrene acrylic type resin, a polyester resin, a fluorocarbon resin, and a phenol resin, etc.

The weight ratio of the carrier being added to the toner is preferable in the following range:

Carrier:toner=1:1 to 20:1

3. Thermal Fixing Apparatus, Image Forming Method and Image Forming Apparatus:

Toner related to the present invention is fixed by an image forming method and an image forming apparatus, comprising a fixing process with a fixing apparatus, which has said heat roller shown in any of FIGS. 1, 2, or 3.

A fixing apparatus (or a fixing device) of the present invention is usually provided with a heat roller, as shown in FIGS. 1 through 3, and a pressure roller, which is in contact with the heat roller. This apparatus fixes a toner image, formed on a recording medium (or an image holding member, typified by recording paper).

The surface of the heat roller is usually covered with a layer of a releasing resin or a silicone rubber.

The base metal of the heat roller may be made of a selection of iron or copper or alloy of them, etc. and it's inside diameter may range from 10 to 50 mm.

The thickness of the base metal is usually from 0.1 to 2 mm, and determined by considering the balance of requirement of energy saving (the thinner the better) and the strength of the roll structure, which depends on its composition material. For example, in order to maintain the same strength as an iron base metal with the thickness of 0.57 mm, an aluminum base metal with the thickness of 0.8 mm is required.

The thickness of the covering layer of the roll is usually 0.02 mm or more. In cases of "soft fixing", the thickness is preferably 0.5 to 10 mm, and is more preferably 1.0 to 5 mm. In cases where the thickness is less than 0.2 mm, enough nip width cannot be obtained; therefore the sufficient effect of soft fixing may not be achieved.

The pressure roller is usually covered on its surface of the base metal with a rubber layer. Herein, the rubber layer is not specifically restricted, but a urethane rubber or a silicone rubber, etc. can be used, and preferably used is a heat resistant silicone rubber.

The base metal of the pressure roller is comprised of metal such as aluminum, iron, etc. or alloys of these metals.

The thickness of the covering layer is usually 0.2 mm or more, is preferably 0.5 to 10 mm, and is more preferably 1.0 to 5 mm. In cases where the thickness is less than 0.2 mm, enough nip width cannot be obtained; therefore the sufficient effect of soft fixing cannot be achieved.

The ASCAR C hardness of the rubber composing the covering layer is usually between 35 and 75, and is preferably 40 to 50; and a silicone rubber is preferably employed. In cases where the ASCAR C hardness of the rubber is lower than 35, the rubber is too soft and may cause problems of durability, while in cases where the ASCAR C hardness is higher than 75, the rubber is too hard to apply even pressure.

The pressure load (total pressure load) between the heat roller and the pressure roller is normally 40 to 350 N, is preferably 50 to 300 N, and is more preferably 50 to 250 N. This pressure load is defined in relation to the mechanical strength of the heat roller; for example, in the case of a heat roller having an iron base metal with a thickness of 0.3 mm, a pressure load of 250 N or less is preferable. In cases where the pressure load is less than 40 N, a sufficient fixing effect may not be obtained due to insufficient pressure; and in cases of more than 350 N, too much load may be applied onto the rollers.

From the viewpoints of offset resistance characteristics and fixing ability, the nip width between the rollers is preferably 4 to 8 mm; and the pressure at the nip surface is preferably 0.6 to $1.5\times10^5$ Pa.

As an example of the fixing condition of the present invention, a fixing temperature (surface temperature of the heat roller) is 130 to 240° C., and linear speed of fixing is 80 to 640 mm/sec.

The fixing apparatus of the present invention, if necessary, can be provided with a cleaning mechanism at the fixing section. In this case, a method for supplying silicone oil to the rollers in the fixing section, using a pad, a roll, or a web, etc., which is impregnated with silicone oil, can be employed for cleaning the rollers.

As for the silicone oil, a high heat resistance type, such as polydimethyl silicone, polyphenylmethyl silicone, and polydiphenyl silicone, etc. may be used. As the lower the viscosity is, the more oil may be supplied to the rollers, so that the silicone oil with a viscosity of 1 to 100 Pa·s at 20° C. is preferably used.

Specifically, the present invention is highly effective by applying a method of constantly supplying a certain amount of the silicone oil. In this case, although the amount of supplied silicone oil is not specifically defined, a supply of about 0.1 to 5.0 $\mu g/cm^{2,}$ is preferable, as the silicone oil adhering to paper is maintained in a small amount. Further, this amount is preferable since the difficulty of writing by ballpoint pen on the paper, on which silicone oil is adhered, is eliminated, and moreover, the generation of fixing offset problem is also eliminated.

Although, fixing devices using a heat roller and a pressure roller are explained in the above description, a heat belt type fixing device or a fixing device provided with a pre-heating mechanism can also be successfully used.

Figure 4:
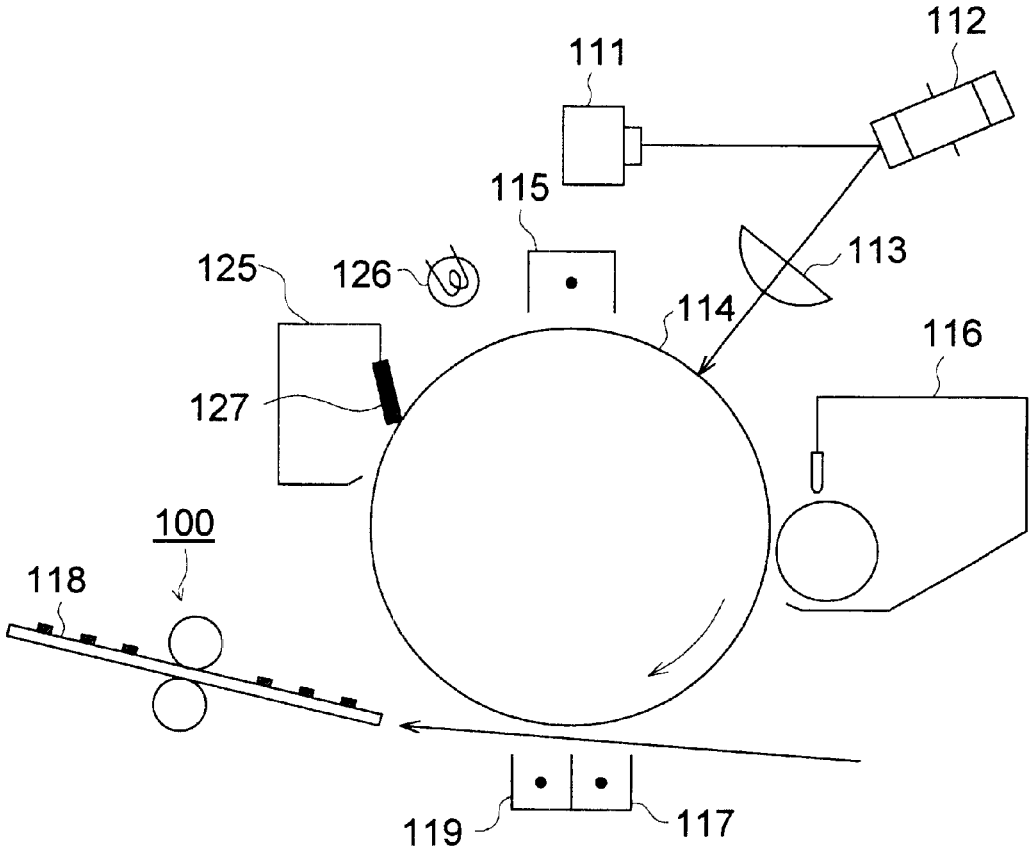
FIG. 4 is a schematic illustration of an image forming apparatus relating to the present invention.

In the following paragraphs, an example of an image forming method and an image forming apparatus relating to the present invention will be described. FIG.4 is a schematic illustration of an image forming apparatus relating to the present invention. A photosensitive drum 114 is a typical example of an electrostatic latent image forming member of the present invention. Said drum is comprised of an aluminum drum base, and an organic photoconductor layer, which is a photosensitive material, formed on the peripheral surface of the drum, and rotates in the arrowed direction with a predetermined speed. In this example of the embodiment, the diameter of the photosensitive drum 114 is 60 mm.

In FIG. 4, the photosensitive drum is previously charged uniformly by a charging device 115, and rotates clockwise synchronizing with the timing of the image exposure. Based on information read by the original reading apparatus (not illustrated), exposing light is emitted from a laser diode 111. A polygon mirror 112 reflects the laser light so as to scan the photosensitive drum surface through a fθ lens, which compensates for image deformation, and forms an electrostatic latent image.

Said electrostatic latent image on the photosensitive drum surface is developed by a developing device 116; and the developed toner image is transferred, by the effect of a transfer charger 117, onto a recording medium 118, which is transported synchronizing to the image. The recording medium 118 is separated from the photosensitive drum by a separation charger 119, while the toner image maintained on the recording medium 118 is led to a fixing apparatus 100 and fixed.

Toner particles etc., remaining on the photosensitive drum surface after the transfer process, are removed by a blade type cleaning device 125, and residual charges are eliminated by a pre-charging lamp 126, while the photosensitive drum is uniformly charged by the charging device 115 for the next image formation.

Herein, the cleaning blade 127 is comprised of a rubber-like elastic material with a thickness of 1 to 30 mm, for which a polyurethane rubber is most frequently used.

According to the first embodiment of the present invention, in the inducing heating type fixing apparatus, by using a high magnetic permeability and high electro conductivity alloy at a heat-receiving member, eddy current is effectively generated and a fixing apparatus with a short warm-up time can be provided.

According to the second embodiment of the present invention, a fixing apparatus can be provided, wherein temperature overshoot, which usually occurs even in the inducing heating type fixing apparatus, can be substantially suppressed, and in cases where the heat receiving member is overheated, the heat generating rate can be reduced.

According to the third embodiment of the present invention, a fixing apparatus can be provided, wherein uneven temperature of the heat-receiving member (or heat roller) in the circumferential direction is decreased.

Hereinafter, the structure to attain the fourth object of the present invention will be described in detail.

The fixing apparatus of the present invention is an apparatus that utilizes the electromagnetic induction system and is able to deal with cases of various modes, in the process of forming fixed images, where various power consumption distributions are required, such as a warming up mode, a large sized paper transporting mode, a small sized paper transporting mode, and a standby mode, etc., wherein the electromagnetic induction at the coil near the center of the heat receiving member in the longitudinal direction, and the electromagnetic induction at the coil in both side areas can be flexibly controlled according to the fixed image forming modes.

Figure 5:
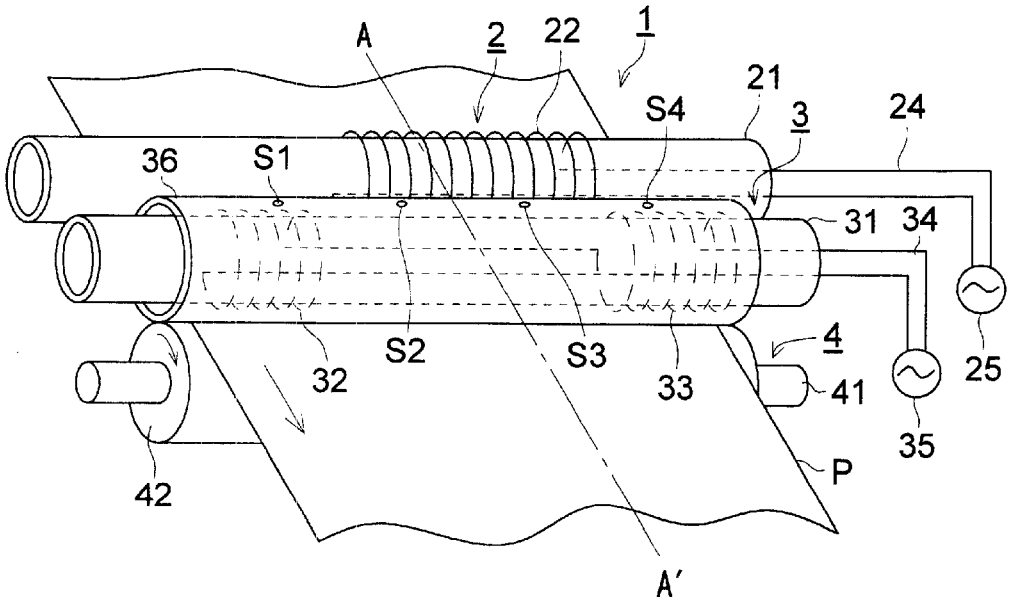
FIGS. 5(*a*), 5(*b*) and 5(*c*) each is an illustration showing a fixing apparatus, having a heating means of helical coils.
Figure 5:
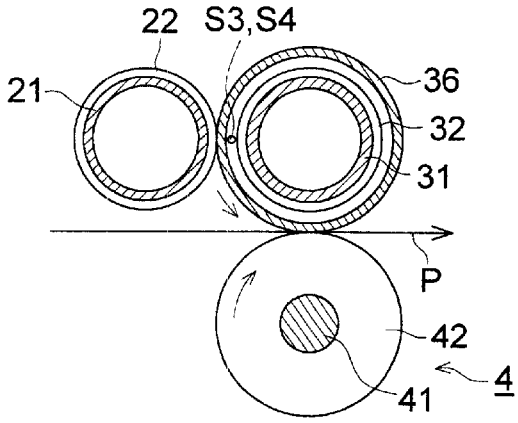
Figure 5:
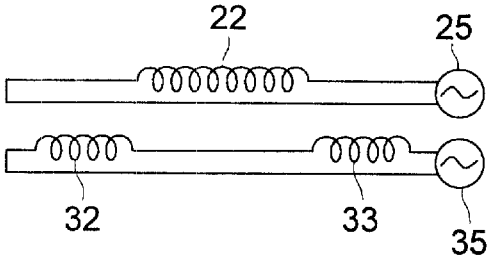

FIG. 5 is an illustration showing an example of a fixing apparatus, which has a heating means 1 using helical coils, embodying claim 1 and claim 2 of the present invention, and FIG. 5(*a*) is a perspective view of said fixing apparatus. In FIG. 5(*a*), the heating means 1 separately comprises an outer coil means 2 and a heat roller 3. In the outer coil means 2, a helical coil 22 is wound and provided around a center area of a bobbin 21, and the coil 22 is connected to a high frequency AC power source 25 via a connecting wire 24, and the bobbin 21 is rigidly mounted to a mounting plate of the fixing apparatus (not illustrated) with a fixing bracket. In the heat roller 3, a coil 32 and a coil 33 are wound around near the both ends areas of a bobbin 31, both of the coils connected in series are connected to a high frequency AC power source 35, and the bobbin 31 is rigidly mounted to a mounting plate of the fixing apparatus (not illustrated) with a fixing bracket. Further, in the heat roller 3, a cylindrical heat-receiving member 36 is rotatably mounted onto a mounting plate of the fixing apparatus via a bearing such as a ball bearing, etc.

A pressure means (or a pressure roller) 4 is a means that, cooperating with the heat roller 3, holds and transports and fixes the recording medium P carrying toner images with heat and pressure, and is driven to rotate by a gear, a motor and/or a reduction gear (not illustrated). FIG. 5(*b*) is a cross section taken on line A–A' in perpendicular direction to an axis of the heat roller 3. FIG. 5(*c*) is a wiring diagram of a coil 22 in the outer coil means 2 and coils 32, 33 in the heat roller 3.

The bobbin 21 of the outer coil means 2 and the bobbin 31 of the heat roller 3 are usually made of plastic cylinders. The power sources 25, and 35 supply high frequency AC power of 5 kHz or higher and preferably 10 to 200 kHz. By selecting this frequency range of the power sources, merits of noise free, low power loss, and low radiation noise to surroundings can be achieved. By applying high frequency AC to the coils, eddy current is generated in the heat-receiving member 36, which rotates in the arrowed direction, in the heat roll 3, and the member 36 is heated. The recording medium P carrying toner images is held and transported to be fixed by the heat roller and the pressure roller rotating in pressure contact with each other. The heat-receiving member 36 is preferable in which the eddy current is effectively generated in the member with the alternating magnetic field induced by the coil. And, magnetic metal materials with high heat conductivity and high electro conductivity such as iron, or alloys of iron, nickel and cobalt, etc. are preferably used for it. As materials for the coils, preferably used is a litz line that is made of stranded plural thin wires of cupper or aluminum, etc., and in this case, advantages of low heat generation in the coil, high magnetic field generation efficiency, and high heat generation efficiency in the heat-receiving member are achieved.

In the above fixing apparatus, the coil 22 is provided around a center area of the bobbin 21, and the coil 32 and the coil 33 are provided around near the both end areas of the bobbin 31 in the heat roller 3, however, embodiments of the present invention are not restricted to this configuration, and at least one out of the coil 22, 32 and 33 is provided at the outer coil means 2, and the remaining coil may be provided on the bobbin 31 of the heat roller 3.

Figure 6:
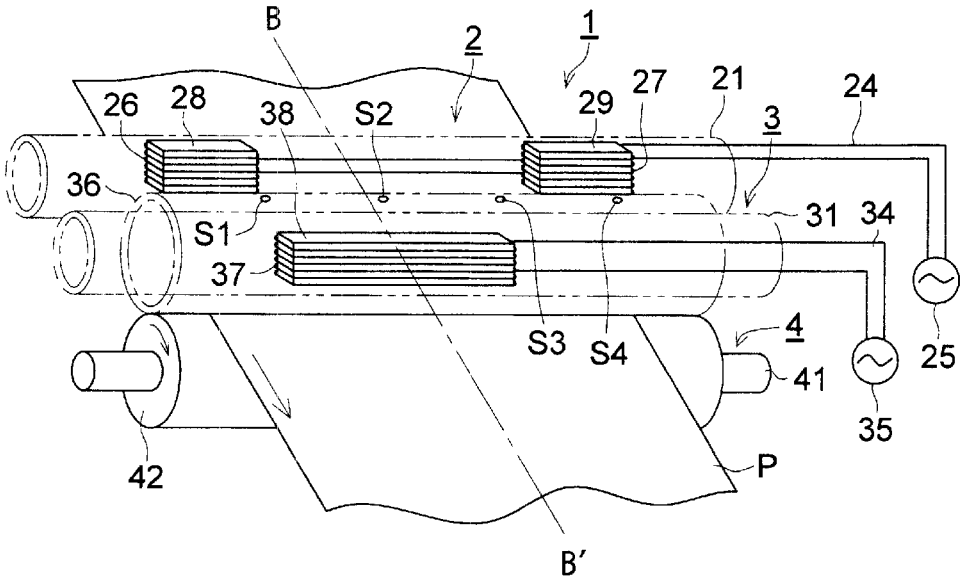
FIGS. 6(*a*),(*b*) and 6(*c*) each is an illustration showing a fixing apparatus, which has a heating means using vertically wound coils.
Figure 6:
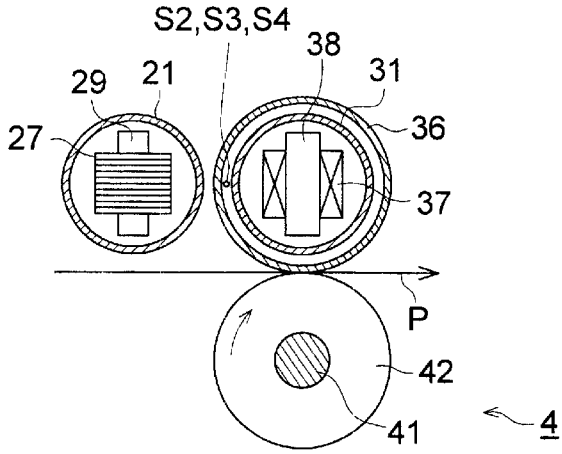
Figure 6:
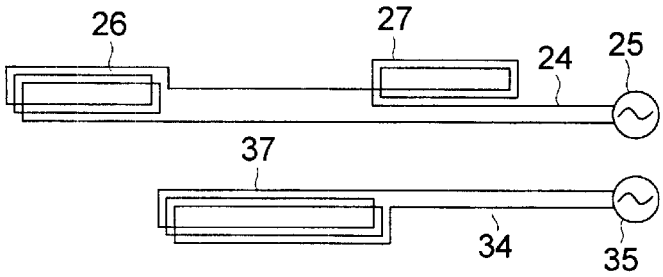

FIG. 6 is an illustration showing an example of fixing apparatus, which has a heating means 1 using vertically wound coils, embodying (10) and (11) of the present invention. FIG. 6(*a*) is a perspective view of said fixing apparatus. FIG. 6(*b*) is a cross section taken on line B–B' in perpendicular direction to an axis of the heat roller 3. FIG. 6(*c*) is a wiring diagram of vertically wound coils 26, 27 and 37. And the same denotations are used for the same things as in FIG. 5. In FIGS. 6, 28 and 29 denote cores provided in the bobbin 21 of the outer coil means 2, and 26 and 27 denote the coils vertically wound and provided around the core 28 and 29. Further, 38 denotes a core provided in the bobbin 31 of the heat roller 3, and 37 denotes the coil vertically wound around the core 38. As the materials of the cores provided in the bobbin 31 and 21, preferably used are ferromagnetic materials with high magnetic permeability such as ferrite, magnetite, and iron oxide typified by hematite, or laminated steel plate, etc.

In the fixing apparatus of FIG. 6 using vertically wound coils, in the same way as the case of using helical coils shown in FIG. 5, the coils are connected to the high frequency AC power source 25 and 35, and the heat-receiving member 36 in the heat roller 3 is heated by electromagnetic induction, and the heat roller 3 and the pressure roller 4 hold and transport the toner image bearing recording medium P to fix with heat and pressure.

In the fixing apparatus shown in FIG. 6, the coil 26 and 27 are provided near the both end areas of the bobbin 21 in the outer coil means 2, and the coil 37 is provided at center area of the bobbin 31 in the heat roller 3, however, embodiments of the present invention are not restricted to this configuration, and at least one out of the coil 26, 27 and 37 is provided at the outer coil means 2, and the remaining coil may be provided on the bobbin 31 in the heat roller 3.

In the drawings from FIG. 6 and after, for easy understanding, the bobbins 21 and 31 in the outer coil means 2 and the heat roller 3, and the heat-receiving member 36 are represented with two-dot chain lines, and the cores 28, 29, 38 and the coils 26, 27 and 37 are represented with solid lines.

Figure 7:
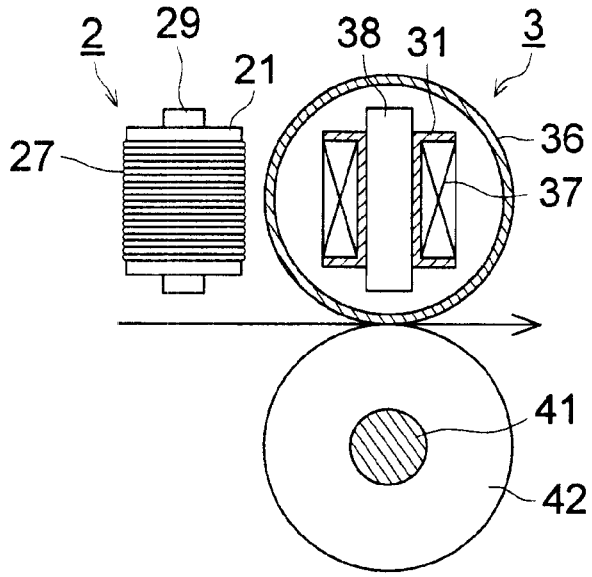
FIGS. 7(*a*) and 7(*b*) each is a section view showing a variation of fixing apparatus in FIG. 6.
Figure 7:
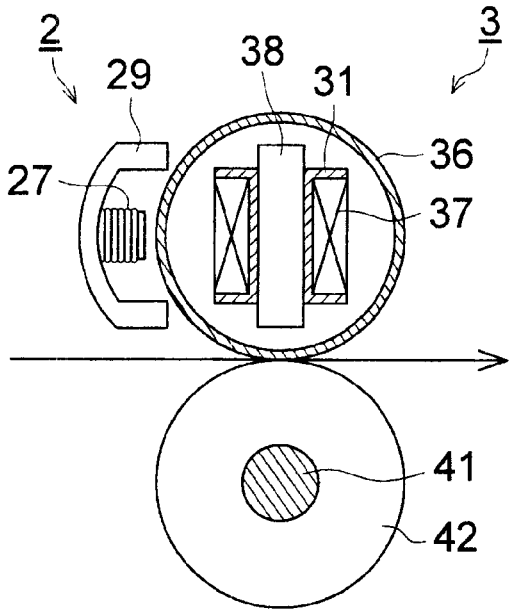

FIG. 7 is a section view showing a variation of FIG. 6. FIG. 7(*a*) and FIG. 7(*b*) are section views showing variations of the core and the coil in FIG. 6(*a*). FIG. 7(*a*) is an example where U-shaped bobbins 21 and 31 are provided on peripheries of the core 29 in the outer coil means 2, and of the inner core 38 in the heat roller 3, and coils 27 and 37 are wound around said bobbins 21 and 31.

FIG. 7(*b*) is a further improved example from FIG. 7(*a*), wherein the core 29 in the outer coil means 2 is made E-shaped and the coil 27 is wound at the illustrated position. By designing the outer coil means 2 as illustrated in FIG. 7(*b*), alternating magnetic flux generated from the coil 27 is applied to the heat-receiving member without loss, and the heat-receiving member 36 can be effectively heated.

In the fixing apparatuses shown in FIG. 5, FIG. 6 and FIG. 7, the coil which heats the center area of the heat-receiving member, and the coil which heats the area near the ends, are wound around different bobbins to each other, due to this, impediments such as diminish or extinction of the magnetic field caused by interference are avoided, and independent temperature controls become possible, and a proper control of the temperature distribution in the heat receiving member 36 becomes possible. In further preferable embodiment, where the electric power sources for the coil in central area and for the coils in near end areas are separated to independent power sources, and the coils in near end areas are connected in series, the appropriate control of the temperature distribution in the heat-receiving member 36 becomes more easy.

Figure 8:
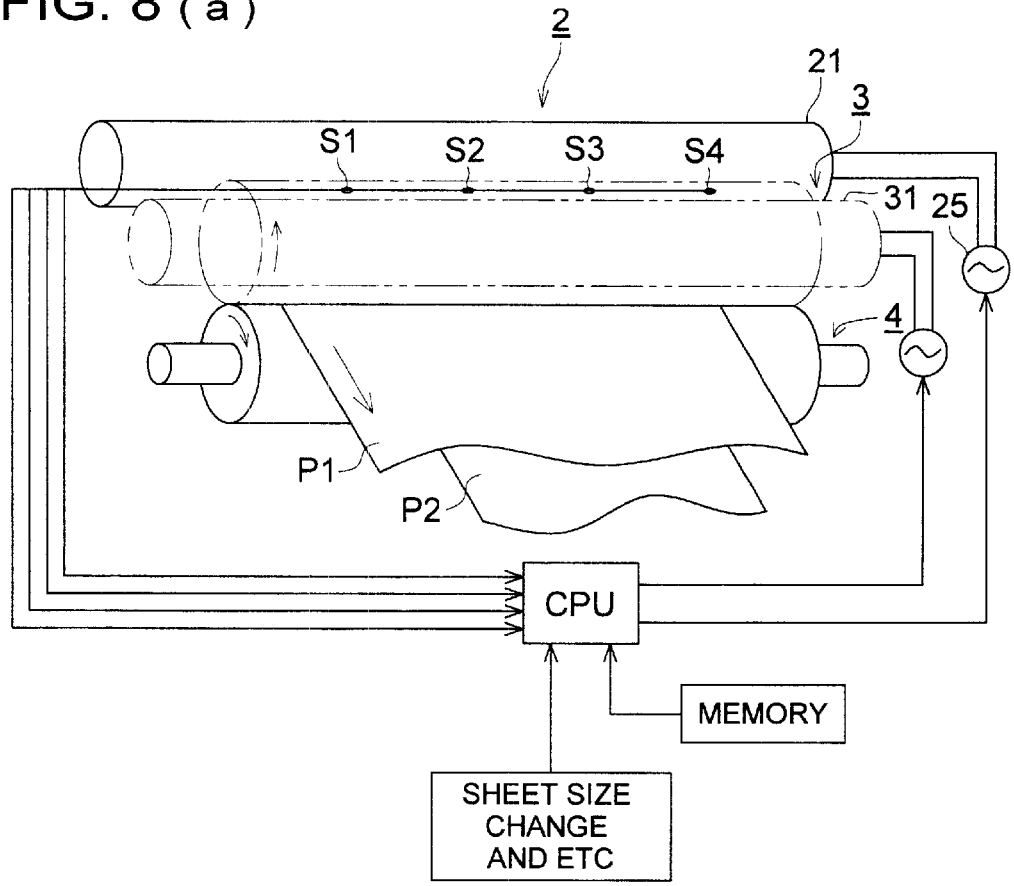
FIGS. 8(*a*), 8(*b*) and 8(*c*) each is a drawing illustrating a temperature control system for the fixing apparatus in FIG. 5, FIG. 6 and FIG. 7.
Figure 8:
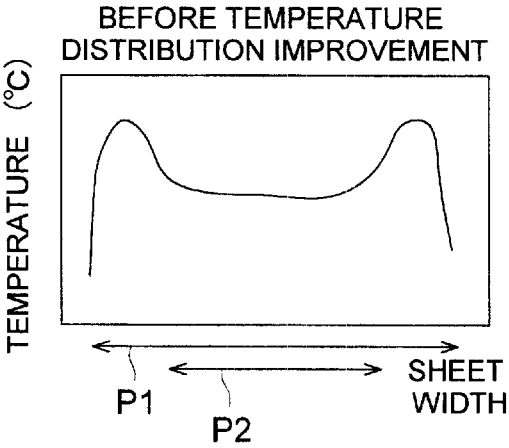
Figure 8:
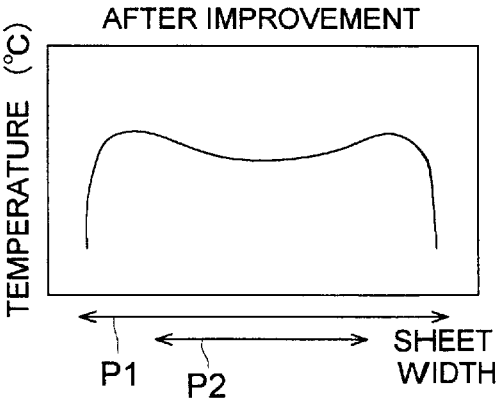

FIG. 8 is a drawing illustrating a temperature control system for the fixing apparatus in FIG. 5, FIG. 6 and FIG. 7. In the fixing apparatus of FIG. 5, FIG. 6 and FIG. 7, S1, S2 and S3 are temperature sensors provided on the inner surface of the heat-receiving member 36. When operating condition change, such as paper size change, occurs in the fixing process, said sensors check the temperature distribution in the heat receiving member 36 if it is appropriate or not. In the case of inappropriateness, the AC currents from the power source 25 and 35 are controlled through a CPU, and an appropriate temperature distribution can be achieved. FIG. 8(*a*) is a drawing illustrating a control method for the temperature distribution in the heat-receiving member 36, and the same denotations are used for the same things as in FIG. 9 or FIG. 6. In FIG. 8(*a*) for example, in cases where paper size is changed from a large size P1 to a small size P2, signals from a memory means, which memorizes predetermined appropriate temperature distribution, and the temperature distribution signals from the sensor S1, S2, S3 and S4 are compared, and the currents from the power sources 25 and 35 are controlled through the CPU, so that the temperature distribution reaches the one in the memory means, and the temperature distribution is improved. FIG. 8(*b*) shows the temperature distribution of the heat-receiving member 36 before the improvement, and FIG. 8(*c*) shows the one after the improvement.

In FIG. 8(*b*) showing before the improvement, after the paper size is changed from P1 to P2, the temperature distribution is inadequate as the temperature near the side edges rises too high, and problems such as parts damage, improper fixing or unnecessary power consumption may be caused. While, after the improvement, as shown in FIG. 8(*c*), temperature distribution is equalized and performance is preferable such that uniform fixing can be achieved without unnecessary power consumption.

Figure 9:
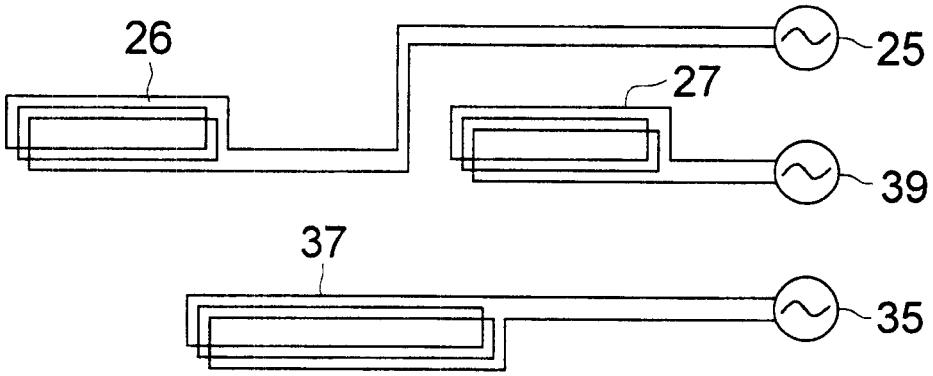
FIG. 9 is a connection diagram showing that each coil in the fixing apparatus is connected to independent power source to be controlled independently.
Figure 11:
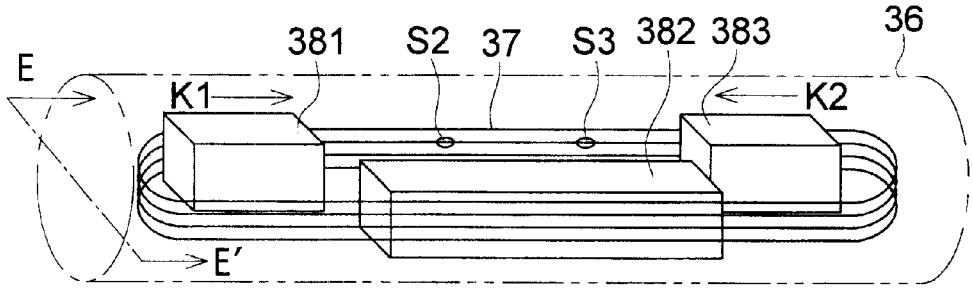
FIGS. 11(*a*) and 11(*b*) each shows a more improved fixing apparatus than the one in FIG. 10.
Figure 11:
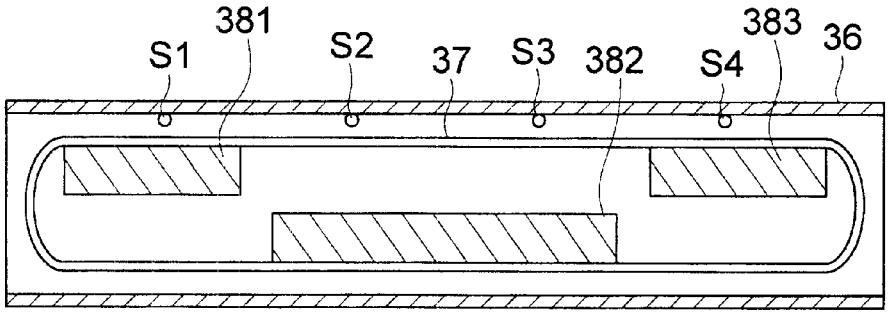

FIG. 9 is a connection diagram showing that each coil in the fixing apparatus of FIG. 6 is connected to independent power source to be controlled independently, wherein wirings of the coils 26 and 27 in the outer coil means 2 and the inner coil 37 in the heat roller 3 are replaced from the one shown in FIG. 6(*c*) to that of FIG. 9. That is, by connecting the coils 26, and 27 in the outer coil means 2 and the inner coil 37 in the heat roller 3, respectively to the separate power sources, the temperature distribution in the heat-receiving member is equalized, and the fixing efficiency and the energy saving effect can be improved.

FIG. 10 is a drawing illustrating a configuration of the fixing apparatus of (13) and (14). FIG. 10 (*a*) is a perspective view of a fixing apparatus, wherein the temperature distribution in the heat-receiving member is equalized by moving the core in the coil. FIG. 10(*b*) is a cross section taken on line C–C' in the perpendicular direction to the axis of the heat roller 3. The same denotations are given to the same things as in FIG. 10. The fixing apparatus of FIG. 10 controls the temperature distribution of the heat receiving apparatus 36, by moving a core in the fixed vertically wound coil 37. For example, in cases where paper size is changed from P1 to P2, and the temperature distribution measured by the temperature sensors S1, S2, S3 and S4 is inappropriate as shown in FIG. 8(*b*), according to this embodiment, by comparing with the appropriate temperature distribution for P2 size paper previously memorized, cores 381 and 383 are moved so that the appropriate temperature distribution as shown in FIG. 8(*c*) can be attained. Namely, in the inner coil 37 of the heat roller 3, there are incorporated multiple cores of 381, 382 and 383, and the core 381 and the core 383 is movably supported with core support members 384 and 385 having racks R1 and R2, and said racks R1 and R2 of the core support member 384 and 385 are engaged with pinion gears G1 and G2 and are driven to move back and forth (K1 direction and K2 direction or opposite directions).

FIG. 7 shows a more improved fixing apparatus than the one in FIG. 10, and the same denotations are given to the same things in FIG. 10. In the fixing apparatus of FIG. 10, since the separate cores are arranged on the same axis line, the movable ranges are rather short, and the controllable range of the temperature distribution in the heat-receiving member is rather small. In the fixing apparatus of FIG. 7, among the cores 381, 382 and 383, the cores 381 and 383 are movably provided on the same axis line shown back in the drawing, and the core 382 is provided on the other axis line shown in front in the drawing. Herein, the cores 381 and 383 can be moved in the direction of K1 and K2 up to inside of the longitudinal width of the core 382, and the temperature distribution in the heat-receiving member 36 can be controlled in a wider range. For example, in cases where the paper feeding is changed from a short edge feeding of B4 paper to a short edge feeding of A4 paper, and the temperature distribution measured by the sensors S1, S2, S3 and S4 is inappropriate as shown in FIG. 8(*b*), based on the comparison to the previously memorized temperature distribution data which is appropriate for the short edge feeding of A4 paper, control means (not shown in FIG. 7, but the control means in FIG. 10 or any other control means can be employed) moves the cores 381 and 383 in the K1 and K2 direction, and the appropriate temperature distribution as shown in FIG. 8(*c*) can be easily achieved.

As demonstrated by the embodiments, according to the fixing apparatus of the present invention, even in cases where various modes required in the process of forming fixed images are changed, specifically when transported paper size is changed, excellent advantages can be attained such that, properly fixed images are always obtained and power saving is achieved without unnecessary power consumption.

What is claimed is:

1. A fixing device for fixing a toner image on a sheet, wherein the toner image is formed by a thermally meltable toner, comprising:

an induction heater to heat the toner image, the induction heater comprising a hollow rotatable conductive member, a heating member provided inside the hollow rotatable conductive member, and a Sendust layer provided inside the hollow rotatable conductive member; and a pressing member to press the toner image.

2. The fixing device of claim 1, wherein the conductive member includes a heat generating layer made of a conductive magnetic member whose Curie temperature is higher than a set fixing temperature and lower than a heat-proof temperature of the fixing device.

3. The fixing device of claim 1, wherein the heating member comprises a core made of a magnetic member and an exciting coil provided on the core, and wherein the core is divided into plural core components aligned in the axial direction of the hollow rotatable conductive member and the plural core components are made of plural materials different in Curie temperature.

4. The fixing device of claim 3, wherein the plural core components comprise a first core component located at a section required to heat a small size sheet and a second core component located at a section not required to heat the small size sheet and wherein the Curie temperature of the first core component is higher than that of the second core component.

5. The fixing device of claim 3, wherein the Curie temperature of the core is higher than a set fixing temperature and lower than a heat-proof temperature of the fixing device.

6. A fixing device for heating and fixing a toner image on a sheet, comprising:

a heating member to heat the toner image, the heating member comprising:

a hollow cylindrical heat generating member made of a conductive member and having a first end heating region, a second end heating region and a central heating region provided between the first end heating region and the second end heating region, a central coil located at the central heating region, an end coil having a first end coil located at the first end heating region and a second end coil located at the second end heating region, an inner coil supporter provided inside of the hollow cylindrical heat generating member and supporting one of the central coil and the end coil, an outer coil supporter provided in close proximity to the outside of the hollow cylindrical heat generating member and supporting the other one of the central coil and the end coil, and a power source to supply an alternate current to the central coil, the first end coil and the second end coil so that the central coil generates heat on the central heating region, the first end coil generates heat on the first end heating region and the second end coil generates heat on the second end heating region; and a pressing member to press the toner image onto the cylindrical heat generating member.

7. The fixing device of claim 6, wherein the first end coil and the second end coil are serially connected.

8. The fixing device of claim 6, wherein each of the central coil and the end coil is supplied with electric power from an independent power source.

9. The fixing device of claim 6, wherein at least one of the central coil and the end coil comprises a spiral coil and a core and the core is shiftable in the spiral coil.

10. The fixing device of claim 9, wherein the core is divided into plural core components in an axial direction of the spiral coil and at least one of the plural core components is shiftable.

11. The fixing device of claim 6, wherein a first end portion of the central coil overlaps with the first end coil, and a second end portion of the central coil overlaps with the second end coil.

* * * * *